United States Patent [19]

Clark

[11] 4,312,466

[45] Jan. 26, 1982

[54] PISTOL HOLSTER WITH ADJUSTABLE SAFETY STRAP

[75] Inventor: Earl J. Clark, Anaheim, Calif.

[73] Assignee: Tandy Brands, Inc., Fort Worth, Tex.

[21] Appl. No.: 141,583

[22] Filed: Apr. 18, 1980

[51] Int. Cl.[3] ..... F41C 33/02

[52] U.S. Cl. ..... 224/243; 224/192; 224/911

[58] Field of Search ..... 224/243, 192, 198, 238, 224/250, 911

[56] References Cited

U.S. PATENT DOCUMENTS

| | | | |
|---|---|---|---|
| 2,546,774 | 3/1951 | Ohlemeyer | 224/243 |
| 3,011,687 | 12/1961 | Boyt | 224/243 |
| 3,252,638 | 5/1966 | Rolston et al. | 224/243 X |
| 4,022,361 | 5/1977 | Devlin | 224/192 |
| 4,076,156 | 2/1978 | Katz | 224/243 |

*Primary Examiner*—Steven M. Pollard

*Attorney, Agent, or Firm*—Robert A. Felsman

[57] ABSTRACT

A pistol holster has features that allow the safety strap to be adjusted to accommodate different sizes of pistols. The safety strap has an outer end secured to the outer portion of the holster body by a releasable fastener. The inner end of the safety strap is secured also by a releasable fastener. The inner fastener allows the strap to be fastened at various points along the length of the holster to vary the dimensions of the loop defined by the strap. The strap passes through a slot in the side of the holster to retain it. A flap depends from the top of the holster for protecting the inner fastener. Preferably, the inner fastener consists of strips of material that adhere to each other when pressed into contact.

4 Claims, 5 Drawing Figures

Fig. 1
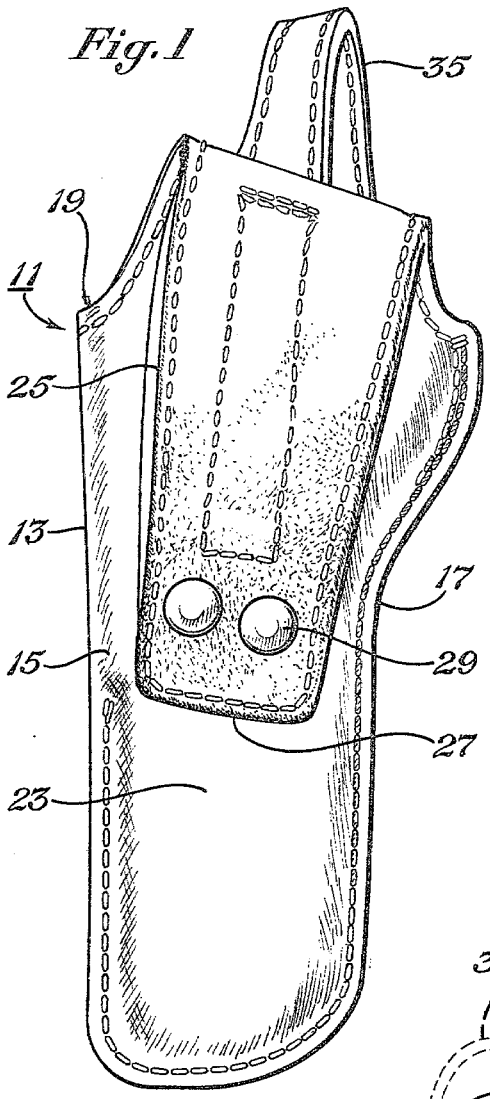
Fig. 2
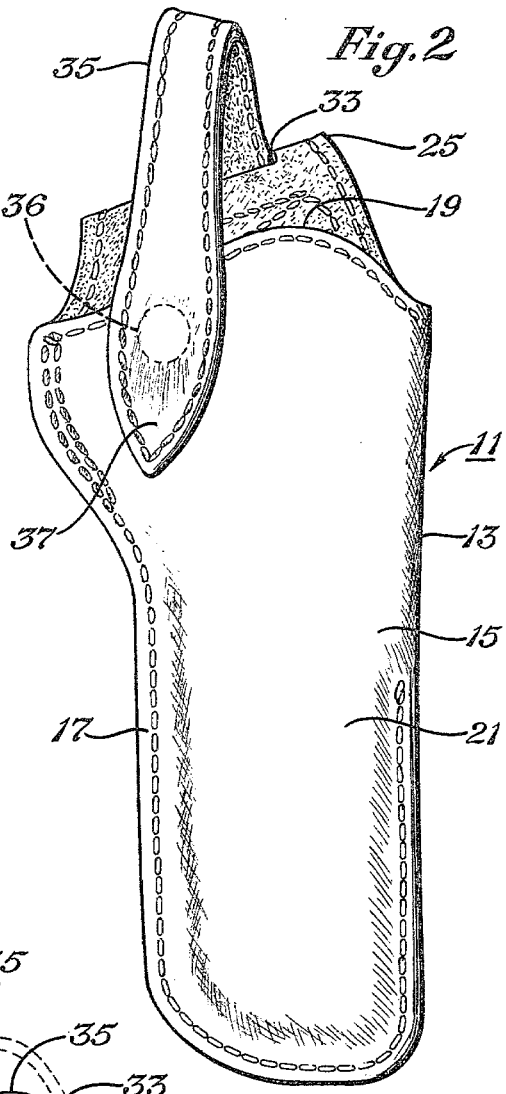
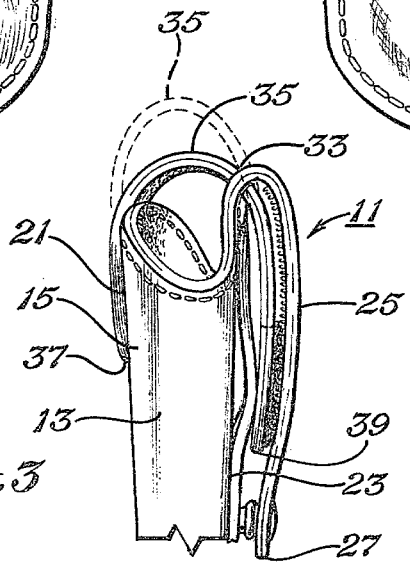
Fig. 3

PISTOL HOLSTER WITH ADJUSTABLE SAFETY STRAP

BACKGROUND OF THE INVENTION

1. Field of the Invention:

This invention relates in general to holsters, and in particular to a pistol holster with an adjustable safety strap.

2. Description of the Prior Art:

Most holsters for pistols, particularly revolvers, have a safety strap to prevent the pistol from falling out. The safety strap also makes unauthorized withdrawal by an assailant more difficult. Normally, the strap is secured on one end to the side of the holster worn next to the user. The strap loops over the hammer of the pistol and has snap fasteners on its other end for securing to the outer side of the holster.

Revolvers vary considerably in size, particularly in length. A holster pocket often is able to accomodate several different sizes of pistols, however, the safety strap will be too short or too long since some pistols protrude farther out of the holster than others. Consequently, most holsters are constructed to carry only a particular size of pistol. Dealers and manufacturers must have large inventories of holsters as a result.

SUMMARY OF THE INVENTION

It is accordingly a general object of this invention to provide an improved pistol holster.

It is a further object of this invention to provide an improved pistol holster with a safety strap that is adjustable in length for accommodating different sizes of pistols.

In accordance with these objects, a holster is provided of the type having a body with inner and outer portions that define a pocket for receiving a pistol. The inner portion includes a belt loop for receiving a belt for carrying the holster. A safety strap has a conventional outer fastener for securing to the outer side of the outer portion. However, the inner end is not permanently secured to the inner side of the holster, as conventionally, rather is releasably secured. The inner fastener means is of a type that allows the inner end to be fastened at various points along the inner portion, varying the dimensions of the loop defined by the strap.

Preferably, the strap extends through a slot in the top of the inner portion. The inner fastener preferably comprises two strips of material of the type that adhere together when pressed into contact with each other. These strips are sufficiently long so that they may be pressed into engagement at various points along their lengths, varying the dimensions of the loop. The inner portion includes a flap that extends from the top of the inner portion and is releasably secured at its bottom. One of the strips is secured inside the flap and the other on the safety strap.

BRIEF DESCRIPTION OF THE DRAWINGS

FIG. 1 is a side elevational view, as seen from the inner side, of a holster constructed in accordance with this invention.

FIG. 2 is a side elevational view of the holster of FIG. 1, as seen from the outer side.

FIG. 3 is a partial elevational view of the holster of FIG. 1, as seen from its forward edge.

DESCRIPTION OF THE PREFERRED EMBODIMENT

Figure 4:
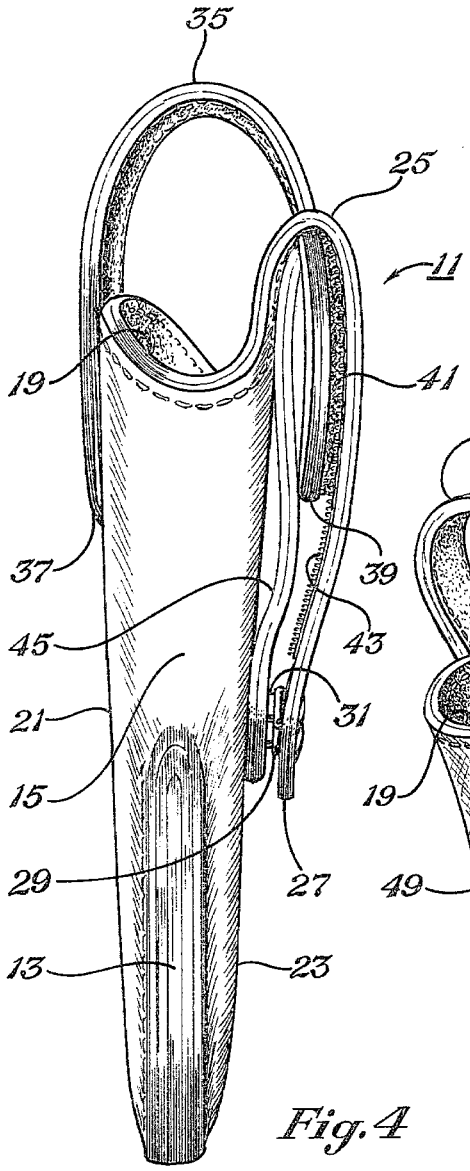
FIG. 4 is an elevational view of the holster of FIG. 1, as seen from the forward edge.

Referring to FIG. 4, holster 11 is shown as viewed from its forward edge 13. Holster 11 has a body 15 that comprises a single piece of leather doubled over and sewn at its rearward edge 17 (FIG. 2) to define a pocket 19 for receiving a pistol (not shown). The forward edge 13 may be sewn upward for a certain distance, as shown. Body 15 has an outer side or portion 21 facing generally outwardly from the wearer, and an inner side or portion 23 worn next to the user.

Figure 5:
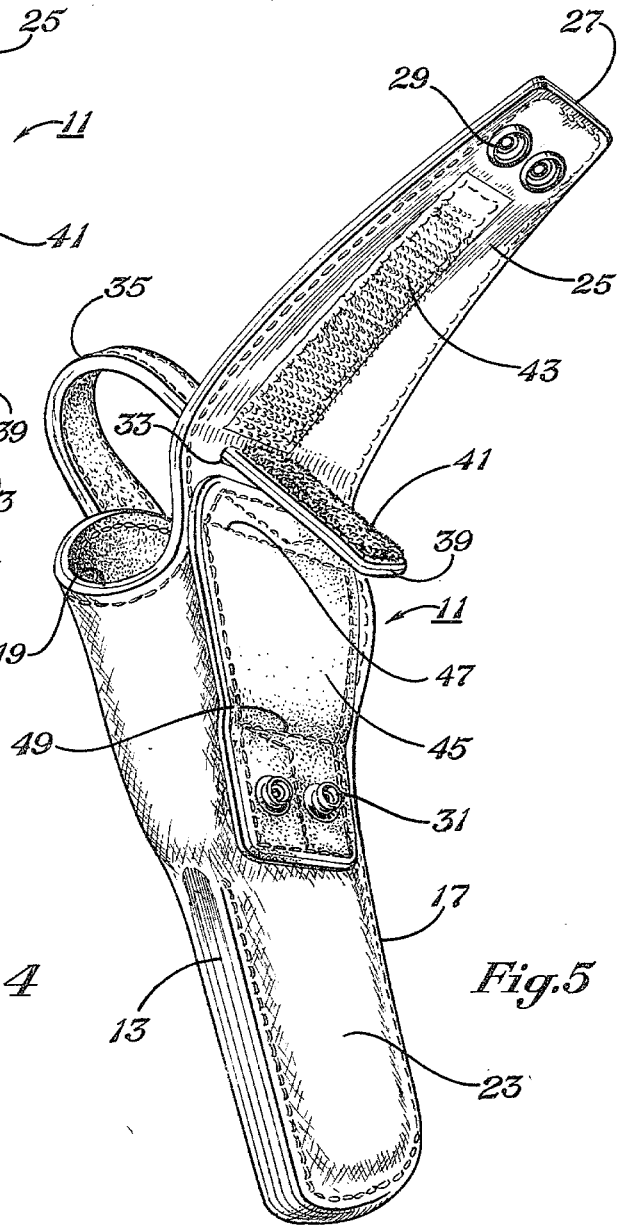
FIG. 5 is a perspective view of the holster of FIG. 1, as shown with the protector flap and safety strap in released conditions.

A flap 25 depends from the upper edge of the inner portion 23. Flap 25 is integral with body 15 and has a lower end 27 that extends about midway down the length of body 15. A pair of snap receptacles 29 are located at the lower end 27 for releasably connecting to mating snaps 31 secured to the inner portion 23. When secured, this defines a closed loop. As shown in FIG. 5, the outer portion 21 and flap 25 have a slot 33 located at the top, in the area where the flap 25 folds over.

A safety strap 35 is closely received in slot 33. Safety strap 35 has an outer end 37 that is secured by mating snap fasteners 36 to the outer portion 21, as shown in FIG. 2. Snap fasteners 36 are of the same type as snap fasteners 29 and 31.

As shown in FIG. 5, the inner end 39 of safety strap 35 is located within the loop defined by flap 25. Inner end 39 has a strip 41 of material sewn to the side that faces the interior of flap 25. A strip 43 of material is sewn to the interior side of the flap 25. Strips 41 and 43 are of conventional materials that adhere together when pressed into mating contact. These materials, known as Velcro, include one strip with a plurality of rows of small, stiff and resilient hooks. The mating strp of material is matted and thick for engaging the hooks in the opposite material. Strips 41 and 43 are rectangular. Strip 43 extends substantially the distance from slot 33 to snap fasteners 29. Strip 41 is about two thirds the length of strip 43, the lengths being preferably about two inches and three inches, respectively.

Referring to FIG. 5, a belt loop 45 of leather is sewn to the inner portion 23. Belt loop 45 is stitched only at its upper end 47 and lower end 49. This defines a clearance or loop as shown in FIG. 4, for receiving a belt (not shown).

In operation, to adjust the safety strap 35 to a particular pistol, the user places the pistol securely in the pocket 19. He should then fasten the outer end 37 of the safety strap 35 to the holster outer portion 21, if possible. The strap 35 fits over the pistol hammer between the hammer thumb grip and the pistol handle. The safety strap inner end 39 should be secured with strips 41 and 43 engaging each other.

If the loop defined by strap 35 is too large, allowing movement of the pistol, then the safety strap 35 should be shortened. It is shortened by releasing the snap fasteners 29 and 31 from each other to provide access to the inner end 39 of safety strap 35, as shown in FIG. 5. Then the inner end 39 is disengaged from flap 25 and pulled downwardly until the strap 35 is tightly located over the pistol. Once tight, strips 41 and 43 are pressed together to reengage the safety strap 35 with the flap 25.

If the strap 35 is too tight, the same process is used to vary the distance from the inner end 39 to the top of the inner portion 21, and thus change the dimension of the safety strap loop. Once properly adjusted, the user's belt is inserted through the belt loop 45 for carrying the holster. The change in dimensions of the loop defined by safety strap 35 is indicated by the phantom lines in FIG. 3.

The snap fasteners 36 serve as outer fastener means on the outer end of the strap 35 for releasably securing the outer end 37 to the outer portion 21. The inner portion 23 is defined herein to include protector flap 25. Strips 41 and 43 serve as inner fastener means on the inner end 39 of safety strap 35 and the inner portion 23 for releasably securing the inner end to the inner portion, and for selectively varying the distance from the inner end 39 to the top of the inner portion 23.

It should be apparent that an invention having significant advantages has been provided. The strap can be quickly released from its inner end to vary the dimensions of the loop. This allows it to receive many different sizes of pistols. The "Velcro" strips provide a strong attachment for the inner end, making it difficult for the strap to be pulled loose. The depending protector flap protects the engaged strips from being torn loose by contact with the user.

While the invention has been shown in only one of its forms, it should be apparent to those skilled in the art that it is not so limited but is susceptible to various changes and modifications without departing from the spirit thereof.

I claim:

1. An improved holster, comprising in combination:

a body folded over and secured to define a pocket for receiving a pistol, the body having inner and outer portions, the inner portion being worn next to the user;

the inner portion including a flap depending from the top of the inner portion, the flap having a lower end releasably secured by snap fasteners to the inner portion, the inner portion having a slot at its top;

a safety strap extending through the slot with an inner end on the inner side, the strap adapted to extend over the pistol, defining a loop and terminating in an outer end that is releasably secured to the outer member by snap fasteners;

a pair of strips of material that adhere to each other when pressed together, one strip being secured to the inner side of the flap and the other to the strap adjacent its inner end, the strips being of sufficient length to allow adherence at selected distances from the inner end to the top of the inner portion to vary the dimensions of the loop defined by the safety strap; and a belt loop secured to the inner portion inside of the flap.

2. In a holster with a body having inner and outer portions defining a pocket for receiving a pistol, an improved safety strap having outer and inner ends forming a loop for extending over a pistol to prevent the removal of the pistol, comprising:

outer fastener means for releasably securing the outer end of the strap to the outer portion;

the inner portion including a flap depending from the top of the inner portion, the flap having a lower end secured to the inner portion for defining a protector loop; and inner fastener means located inside the protector loop for releasably securing the inner end of the strap to the inner member and for selectively varying the distance from the inner end to the top of the inner portion to select the dimensions of the loop defined by the strap, the strap passing through a slot formed in the inner portion adjacent its top;

the inner fastener means comprising mating strips of material that adhere to each other when pressed together, one strip being located on the flap and the other strip being located on the strap adjacent its inner end.

3. In a holster with a body having inner and outer portions defining a pocket for receiving a pistol, an improved safety strap having outer and inner ends forming a loop for extending over a pistol to prevent the removal of the pistol, comprising:

outer fastener means for releasably securing the outer end of the strap to the outer portion;

the inner portion including a flap depending from the top of the inner portion, the flap having a lower end secured to the inner portion for defining a protector loop; and inner fastener means located inside the protector loop for releasably securing the inner end of the strap to the inner member and for selectively varying the distance from the inner end to the top of the inner portion to select the dimensions of the loop defined by the strap, the strap passing through a slot formed in the inner portion adjacent its top;

the inner fastener means comprising mating strips of material that adhere to each other when pressed together, one strip being located on the flap and the other strip being located on the strap adjacent its inner end;

the flap's lower end being secured to the inner portion by mating snap fasteners that are releasable to provide access to the strips of material.

4. In a holster with a body having inner and outer portions defining a pocket for receiving a pistol, an improved safety strap having outer and inner ends forming a loop for extending over a pistol to prevent the removal of the pistol, comprising:

outer fastener means for releasably securing the outer end of the strap to the outer portion;

the inner portion including a flap depending from the top of the inner portion, the flap having a lower end secured to the inner portion for defining a protector loop;

inner fastener means located inside the protector loop for releasably securing the inner end of the strap to the inner member and for selectively varying the distance from the inner end to the top of the inner portion to select the dimensions of the loop defined by the strap, the strap passing through a slot formed in the inner portion adjacent its top;

the inner fastener means comprising mating strips of material that adhere to each other when pressed together, one strip being located on the flap and the other strip being located on the strap adjacent its inner end;

the flap's lower end being secured to the inner portion by mating snap fasteners that are releasable to provide access to the strips of material; and a belt loop secured to the inner portion inside the flap.

* * * * *